US009731328B2

(12) United States Patent
DeFillipi et al.

(10) Patent No.: US 9,731,328 B2
(45) Date of Patent: Aug. 15, 2017

(54) INSPECTION AND SORTING MACHINE

(71) Applicant: Linear Group Services, LLC, Clawson, MI (US)

(72) Inventors: James P. DeFillipi, Leonard, MI (US); Larry N. Wright, Clawson, MI (US)

(73) Assignee: Linear Group Services, LLC, Clawson, MI (US)

( * ) Notice: Subject to any disclaimer, the term of this patent is extended or adjusted under 35 U.S.C. 154(b) by 98 days.

(21) Appl. No.: 14/816,366

(22) Filed: Aug. 3, 2015

(65) Prior Publication Data

US 2017/0036245 A1 Feb. 9, 2017

(51) Int. Cl.

| | |
|---|---|
| ***B07C 5/02*** | (2006.01) |
| ***B07C 5/36*** | (2006.01) |
| ***B07C 5/342*** | (2006.01) |
| ***B07C 5/10*** | (2006.01) |

(52) U.S. Cl.

CPC ..... *B07C 5/363* (2013.01); *B07C 5/02* (2013.01); *B07C 5/10* (2013.01); *B07C 5/342* (2013.01)

(58) Field of Classification Search

CPC .. B07C 5/04; B07C 5/10; B07C 5/342; B07C 5/3422; B07C 2501/009; B07C 1/02; B07C 1/06; B07C 5/02

See application file for complete search history.

(56) References Cited

U.S. PATENT DOCUMENTS 4,476,981 A * 10/1984 Yoshida ..... B65G 47/82 198/370.07
4,687,107 A * 8/1987 Brown ..... B07C 5/3422 209/556
4,869,813 A * 9/1989 Bailey ..... B07C 5/3422 209/538
4,905,842 A * 3/1990 Habele ..... B07C 5/04 209/556
4,938,082 A * 7/1990 Buckley ..... B07C 5/02 198/392
5,299,134 A * 3/1994 Speckhart ..... B07C 5/3412 198/349.95
5,526,437 A * 6/1996 West ..... B07C 5/368 209/577
5,638,657 A * 6/1997 Archer ..... B07C 5/342 53/244

(Continued)

FOREIGN PATENT DOCUMENTS

JP 2000-337843 12/2000

OTHER PUBLICATIONS

Linear GS LV product flyer, www.lineargs.com/pdf/high-speed_inspection.pdf (visited Jul. 8, 2015).

*Primary Examiner* — Joseph C Rodriguez
(74) *Attorney, Agent, or Firm* — Warner Norcross & Judd LLP

(57) ABSTRACT

An inspection and sorting machine and a related method of operation are provided. The inspection and sorting machine includes an inspection system that outputs a first signal corresponding to a fastener condition and a second signal corresponding to an inspection condition. Based on the inspection system output, a controller determines whether a fastener is classified as conforming or whether the fastener is classified as undetermined. Conforming fasteners are diverted into a conforming parts chute, and undetermined fasteners are diverted into a recirculated parts chute. The remaining fasteners are diverted into a reject chute. The undetermined fasteners are recirculated into the inspection and sorting machine for re-inspection.

20 Claims, 9 Drawing Sheets

(56) References Cited

U.S. PATENT DOCUMENTS

| | | | | |
|---|---|---|---|---|
| 5,746,323 | A | 5/1998 | Dragotta | |
| 5,887,073 | A * | 3/1999 | Fazzari | G06K 9/6253 209/580 |
| 6,027,568 | A * | 2/2000 | Wallace | B05B 12/122 118/324 |
| 6,531,672 | B2 * | 3/2003 | Malloy | B07C 5/10 209/579 |
| 6,701,001 | B1 * | 3/2004 | Kenneway | B07C 5/3422 382/141 |
| 6,728,417 | B1 * | 4/2004 | Hara | G01B 11/024 382/145 |
| 6,787,724 | B2 | 9/2004 | Bennett et al. | |
| 2012/0037545 | A1 * | 2/2012 | Van Kasteren | B07C 5/3422 209/577 |
| 2013/0244317 | A1 * | 9/2013 | Degeal | B07C 5/342 435/288.7 |
| 2015/0034534 | A1 * | 2/2015 | Mallett | B07C 7/005 209/583 |
| 2016/0207071 | A1 * | 7/2016 | Cohn | B07C 5/342 |

* cited by examiner

INSPECTION AND SORTING MACHINE

BACKGROUND OF THE INVENTION

The present invention relates to an automated inspection and sorting machine for bulk fasteners and other workpieces.

A growing number of industries require bulk fasteners and other workpieces that meet rigorous tolerance specifications. Imperfections in bulk fasteners can compromise the safety and the functionality of a host device, including for example complex machinery and load-bearing structures. Consequently, a variety of automated inspection and sorting machines have been developed to ensure bulk fasteners meet relevant tolerance specifications.

Existing inspection and sorting machines typically perform the following phases in rapid succession: inspection, decision-making, and sorting. Inspection can include imaging the bulk fasteners with one or more cameras and providing an output for the decision-making phase. The decision-making phase typically is performed in computer logic to rapidly evaluate whether dimensional tolerances (e.g., length, width) and non-dimensional tolerances (e.g., thread count, straightness, taper, roundness) are met. Lastly, the sorting phase typically involves the segregation of those bulk fasteners that meet the relevant tolerances from those bulk fasteners that do not meet the relevant tolerances.

In one known inspection and sorting machine, bulk fasteners are individually transported along a conveyor through an inspection station. The inspection station includes a camera that provides an output. Based on that output, the inspection and sorting machine determines, for each fastener, whether that fastener conforms to relevant tolerances. Conforming fasteners are ejected via an air stream from an air nozzle into a chute for conforming fasteners, while the remaining fasteners are allowed to continue to a chute for non-conforming fasteners. The non-conforming fasteners, and any additional fasteners not determined to be conforming, accumulate at the end of the chute for non-conforming fasteners, which are usually discarded.

Despite the advantages of the above inspection and sorting machine, there remains room for improvement in the automated inspection and sorting of bulk fasteners and other workpieces. In particular, there remains a continued need for an inspection and sorting machine that provides improved sorting under conditions that would otherwise result in the mixing of conforming fasteners with non-conforming fasteners.

SUMMARY OF THE INVENTION

An inspection and sorting machine and a related method of operation are provided. In one embodiment, the inspection and sorting machine segregates inspected fasteners from fasteners that lack a satisfactory inspection. The inspected fasteners are either received by a chute for conforming fasteners or received by a chute for non-conforming fasteners. The fasteners lacking a satisfactory inspection are received by a recirculation chute for re-inspection. The inspection and sorting machine can therefore provide a more efficient inspection and sorting process and can potentially eliminate the re-inspection of non-conforming fasteners and/or facilitate the reinspection of the fasteners that were not properly inspected.

In one embodiment, the inspection and sorting machine generally is adapted to detect system faults in the inspection process in real time, and for each fastener. These system faults can impede a satisfactory inspection, and include for example incorrect fastener spacing, incorrect fastener orientation, excessive fastener speed, obstruction of the inspection optics, controller overrun, and combinations thereof. Fasteners for which an inspection has been impeded by a system fault are ejected into a recirculation chute. The remaining fasteners are sorted into chutes for conforming or non-conforming fasteners.

In another embodiment, the inspection and sorting machine includes a feed system for delivering a plurality of fasteners in a product stream. The feed system is adapted to transport, position, and track the plurality of fasteners. The feed system includes a lower conveyor and an upper conveyor. The upper conveyor includes a magnetic wheel for inverting the fasteners from the lower conveyor. The feed system additionally includes a hopper and a vibrating drum for introducing fasteners onto the conveyors one by one in a linear fashion.

In yet another embodiment, the inspection and sorting machine can also include an inspection system. The inspection system outputs a first signal corresponding to an inspection condition (e.g., a fault signal) and a second signal corresponding to a fastener condition (e.g., a pass signal). Based on the inspection system output, a central controller determines whether the inspection was satisfactory and, if satisfactory, whether the fastener is classified as conforming. Conforming fasteners can be ejected into a conforming parts chute, and uninspected fasteners can be ejected into a recirculated parts chute. The remaining fasteners are accepted into a reject chute.

The inspection and sorting machine can therefore determine, based on the inspection system output, whether fasteners are classified as (a) conforming fasteners; (b) undetermined fasteners; or (c) non-conforming fasteners. For fasteners that are classified as conforming, a first air nozzle can eject these fasteners into a first chute. For fasteners that are classified as undetermined, a second air nozzle ejects these fasteners into a second chute for re-inspection. The non-conforming fasteners continue into a third chute for disposal.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
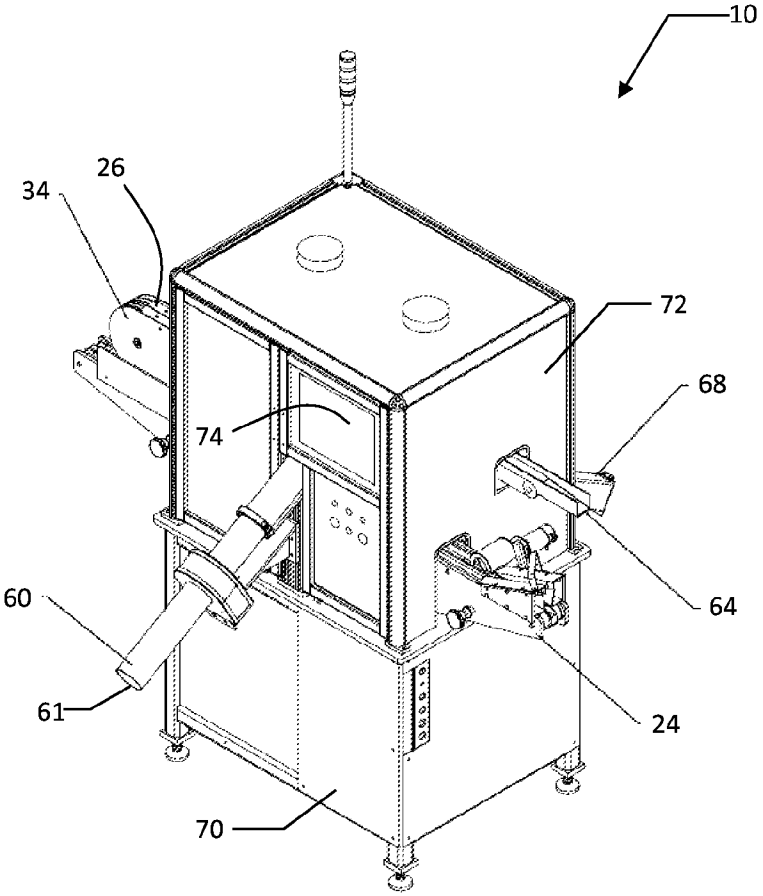
FIG. 1 is a perspective view of an inspection and sorting machine in accordance with a current embodiment.

The current embodiments relate to an inspection and sorting machine and a related method of operation. As set forth below, the inspection and sorting machine segregates inspected fasteners from fasteners that lack a satisfactory inspection. The inspected fasteners are either received by a chute for conforming fasteners or received by a chute for non-conforming fasteners. The fasteners lacking a satisfactory inspection are received by a recirculation chute for re-inspection. Though described below as pertaining to fasteners, for example bolts, nuts, and washers, the inspection and sorting machine is equally well suited for other workpieces benefiting from an automated optical inspection.

To assist in an understanding of the current embodiments, several terms are defined herein. The term "measurable fastener parameter" includes dimensional fastener parameters and non-dimensional fastener parameters. Dimensional parameters include, without limitation, length, height, width, and diameter. Non-dimensional parameters include, without limitation, straightness, taper, roundness, smoothness and thread count. The term "system fault" includes faults that impede the reliable inspection or sorting of fasteners. System faults include, without limitation, improper fastener spacing, improper fastener orientation, improper fastener speed, obstruction of the camera, controller overrun, inoperable controller, inoperable ejectors, and the unexpected absence of a parts box for fasteners. The term "satisfactory inspection" includes an inspection that is substantially free of system faults. The term "conforming fasteners" includes fasteners receiving a satisfactory inspection and having a measurable fastener parameter within expected tolerances. The term "undetermined fasteners" includes fasteners lacking a satisfactory inspection, i.e., a fastener whose actual or attempted inspection was accompanied by one or more inspection system faults. The term "non-conforming fastener" includes fasteners receiving a satisfactory inspection but having a measurable fastener parameter outside of expected tolerances, including fasteners that are malformed, defective, and/or grossly mis-sized. Lastly, "sorting" includes directing fasteners to their designated destination, including both active and passive modes of sorting.

Referring now to FIGS. 1-4, an inspection and sorting machine in accordance with one embodiment is illustrated and generally designated 10. The inspection and sorting machine 10 includes a central controller 12, a feed system 14, an inspection system 16, and a sorting system 18. Each system 14, 16, 18 and its constituent components is discussed in greater detail below. In general terms, the feed system 14 is adapted to transport a plurality of fasteners, the inspection system 16 is adapted to inspect a plurality of fasteners, and the sorting system 18 is adapted to sort a plurality of fasteners. Though described separately for clarity, these systems 14, 16, 18 can be closely integrated, often with a degree of overlap, and provide the near seamless inspection and sorting of bulk fasteners at high part-per-minute speeds.

The feed system 14 is adapted to transport, position, and track a plurality of fasteners in a product stream. In the embodiment illustrated in FIGS. 2-3, the feed system 14 includes a bolt feeder 20, a nut feeder 22, a lower conveyor 24, and an upper conveyor 26. The bolt feeder 20 includes a hopper 28 and a vibrating drum 30 for arranging a plurality of bolts one-by-one in a linear fashion. A slotted ramp 32 accepts each bolt in a shank-down orientation for positioning onto the lower conveyor 24. The lower conveyor 24 includes an endless split belt whose gap can be adjusted to less than the diameter of the fastener head and greater than the diameter of the fastener shank. The upper conveyor 26 includes an endless belt trained about a magnetic wheel 34. The magnetic wheel 34 inverts the bolts from the lower conveyor 24 onto a substantially flat portion of the upper conveyor 26. Similar to the bolt feeder 20 described above, the nut feeder 22 includes a hopper 36 and a vibrating drum 38. The hopper 36 drops nuts or washers (or other bulk workpieces) into the vibrating drum 38. The vibrating drum 38 then introduces the nuts or washers onto the upper conveyor 26 one-by-one in a linear fashion.

Figure 3:
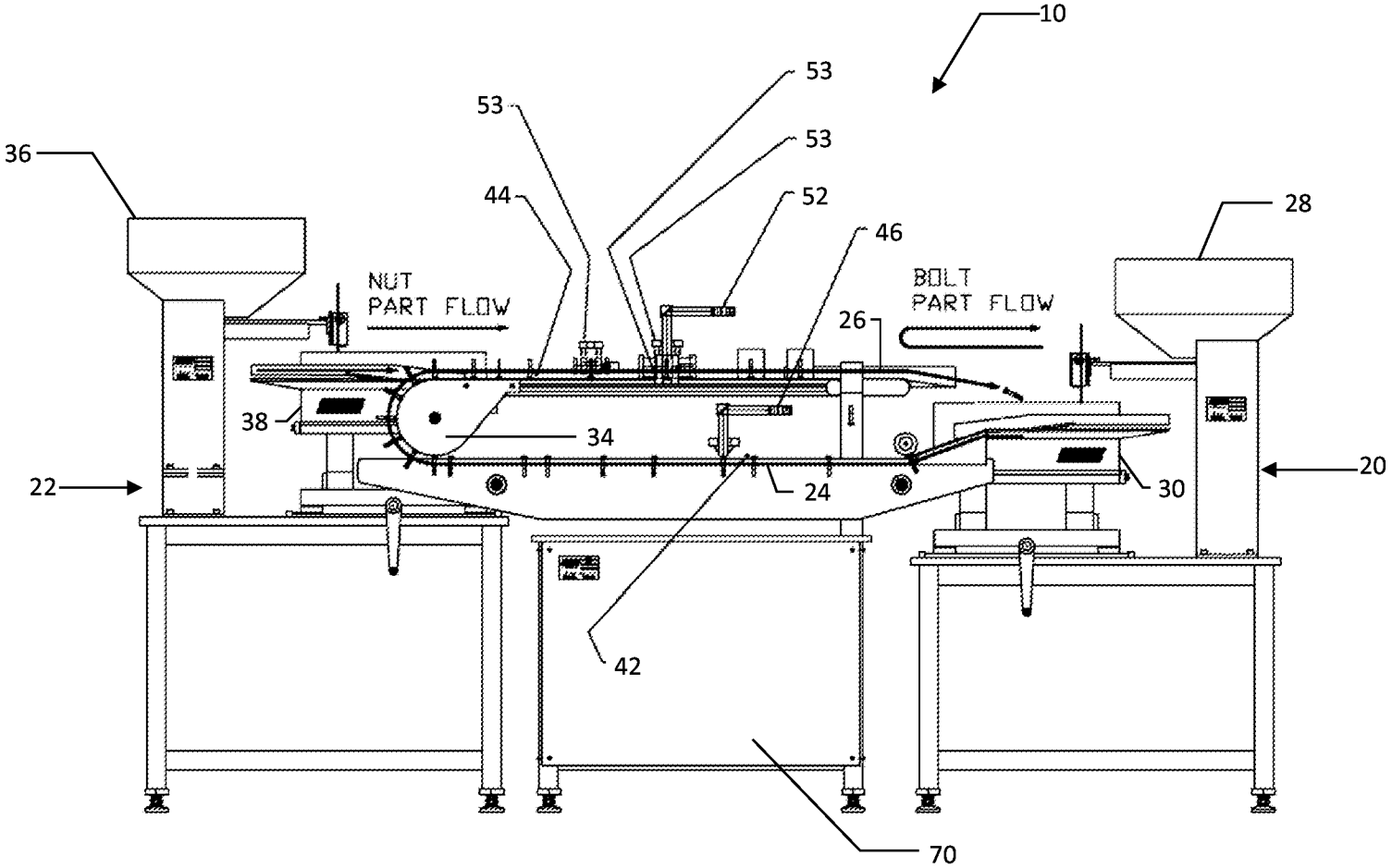
FIG. 3 is a side view of the inspection and sorting machine of FIG. 1 with a cabinet enclosure removed and with the addition of a bolt feeder and a nut feeder.

The feed system 14 also includes part tracking sensors 40 to track each fastener. The part tracking sensors are depicted in FIG. 3 as LED emitter and detector pairs 42, 44. Other part tracking sensors can be used in other embodiments where desired. In one example, the lower conveyor 24 includes a first part tracking sensor 42 and the upper conveyor 26 includes a second part tracking sensor 44. Each part tracking sensor outputs a signal in response to the occlusion of LED light by a passing fastener. The central controller 12 then determines the approximate time each fastener passes by the first or second part tracking sensors 42, 44 on the respective lower and upper conveyor belts 24, 26. Using this information, the central controller 12 generates a registry in computer memory for each fastener in the product stream. As discussed below, the registry is subsequently updated for each fastener based on the inspection system output.

The inspection system 16 is generally adapted to optically inspect each fastener in the product stream. To perform the optical inspection, the inspection system 16 includes a first camera 46 along the lower conveyor 24 and second, third, and fourth cameras 48, 50, 52 along the upper conveyor 26. The cameras provide complimentary images of each fastener in the product stream. For example, the first camera 46 provides a top-down view of the head of each passing bolt, and the fourth camera 52 provides a top-down view of the shank of each passing bolt (shown in FIG. 3). The second and third cameras 48, 50 provide a side view of the shank of each passing bolt (shown in FIG. 2). The cameras can be oriented to provide other views in other embodiments as desired. Each camera can additionally include a strobing back light 53 to provide greater image contrast.

Figure 4:
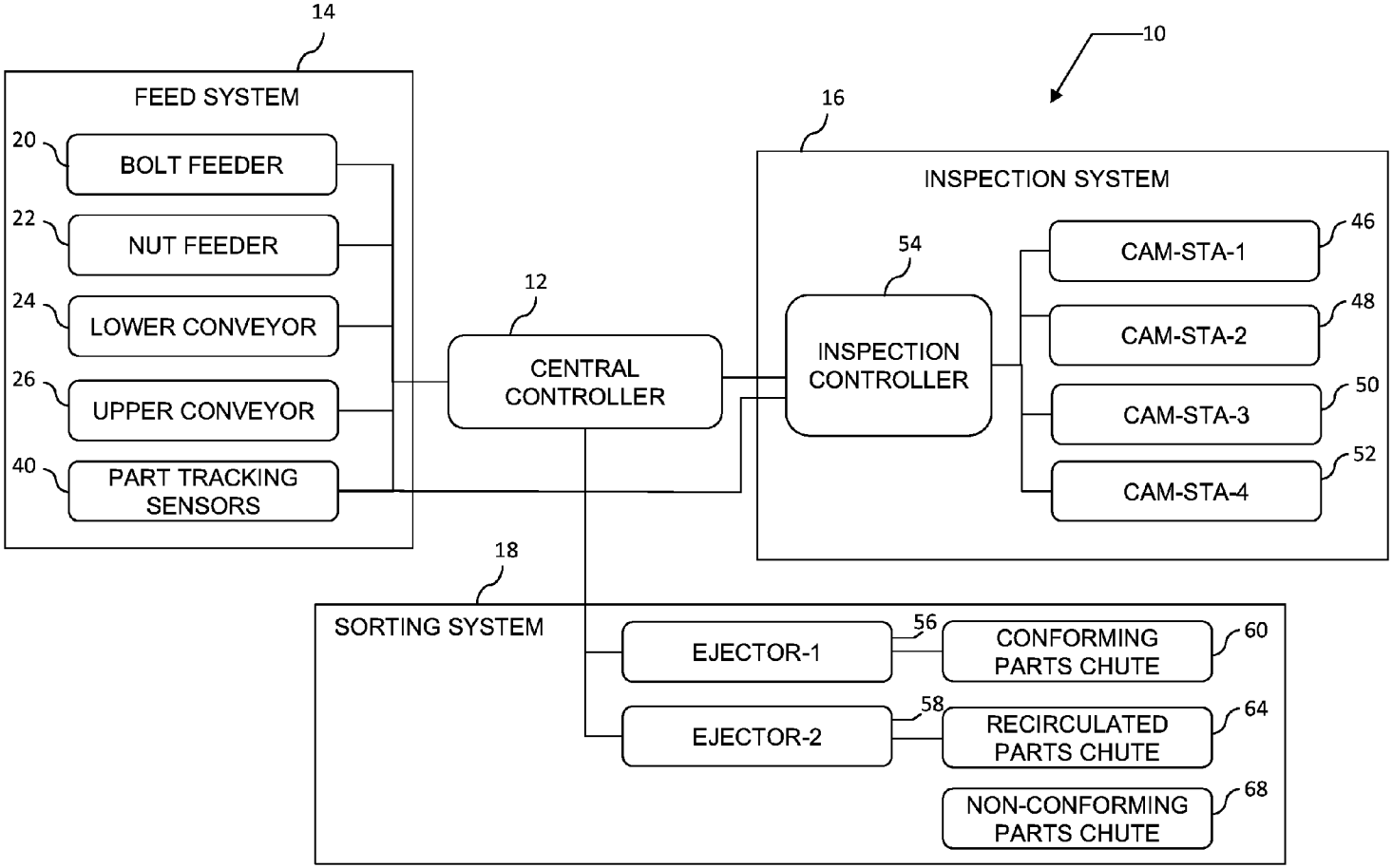
FIG. 4 is a schematic diagram of the constituent systems of the inspection and sorting machine of FIG. 1.

As illustrated in FIG. 4, the inspection system 16 additionally includes an inspection controller 54. The inspection controller 54 can include a programmable logic controller (PLC), a field programmable gate array (FPGA), or an application specific integrated circuit (ASIC), for example. The inspection controller 54 is adapted to determine whether each fastener is a conforming fastener based on the output of each camera. That is, the inspection controller 54 includes instructions in computer readable memory that, when executed, cause the inspection controller 54 to determine whether a measurable fastener parameter conforms to predetermined tolerances. The inspection controller 54 then provides an output to the central controller 12 for the subsequent sorting of the fasteners. For example, the inspection controller 54 can provide a pass signal for each fastener having measurable fastener parameters within the predetermined tolerances. Upon receipt of the pass signal for a particular fastener, the central controller 12 then updates the registry to indicate the fastener is conforming.

In addition to performing an inspection of the passing fasteners, the inspection system 16 is adapted to continuously monitor the inspection and sorting machine 10 for system faults. As noted above, systems faults include faults that impede the reliable inspection or sorting of fasteners. Example system faults include improper fastener spacing, improper fastener orientation, improper fastener speed, obscuration of camera optics, controller overrun, inoperable controller, and inoperable ejectors. For example, the inspection controller 54 can detect an improper fastener spacing based on the output of the part tracking sensors 42, 44 (e.g., in instances where adjacent fasteners are too close to each other for optical inspection). Also by example, the inspection controller 54 can detect improper fastener speed based on the output of the part tracking sensors 42, 44 (e.g., in instances where the conveyor speed is too high for optical inspection). Also by example, the inspection controller 54 can detect an improper fastener orientation based on the camera output (e.g., in instances where the fastener is not upright). Also by example, the inspection controller 54 can detect obscuration of the cameras based on the output of the cameras (e.g., in instances where dust accumulates on the camera lens). Also by example, the inspection controller 54 can detect controller overrun or controller interoperability based on a polling of the central controller 12. In these examples, a satisfactory inspection is indicated by the absence of a fault signal from the inspection controller 54. Upon receipt of the fault signal for a particular fastener, the central controller 12 updates the registry to classify that particular fastener as undetermined. Also by example, the central controller 12 can detect inoperable air nozzles based on a drop in the source air pressure, and can detect the unexpected absence of a box below a conforming parts chute 60 based upon the output of a pressure sensor. In these examples, the central controller 12 automatically updates the registry to classify all fasteners on the conveyors 24, 26 as undetermined until the air pressure returns to normal values or until a parts box is placed below the opening 61 in the conforming parts chute 60.

The central controller 12 can therefore determine, based on the inspection system 16 output, whether each fastener is classified as: (a) a conforming fastener; (b) an undetermined fastener; or (c) a non-conforming fastener. The registry is updated to reflect this determination for each fastener. In the illustrated embodiment, the central controller 12 determines: (a) a conforming fastener based on the presence of a passing signal and the absence of a fault signal; (b) a recirculation fastener based on the presence of a fault signal, regardless of whether a passing signal was also transmitted by the inspection controller 54; and (c) a non-conforming fastener based on the absence of a passing signal and the absence of a fault signal.

In other embodiments, a satisfactory inspection is indicated by an affirmative satisfactory inspection signal from the inspection controller 54. In these embodiments, the satisfactory inspection signal can indicate correct fastener spacing, correct fastener orientation, and correct fastener speed, for example. Upon receipt of the satisfactory inspection signal for a particular fastener, the central controller 12 then updates the registry to indicate the fastener should not be sorted for re-inspection. In this embodiment, the central controller 12 determines: (a) a conforming fastener based on the presence of a passing signal and the presence of a satisfactory inspection signal; (b) an undetermined fastener based on the absence of a satisfactory inspection signal; and (c) a non-conforming fastener based on the absence of a passing signal and the presence of a satisfactory inspection signal.

The inspection and sorting machine 10 also includes a sorting system 18. The sorting system 18 is adapted to sort each fastener based on its classification as a conforming fastener, an undetermined fastener, or a non-conforming fastener. In the illustrated embodiment, the sorting system 18 includes first and second ejectors 56, 58 for removing the conforming fasteners and the undetermined fasteners from the upper conveyor 26. The ejectors can include any device adapted to cause a fastener to enter a designated chute. In the illustrated embodiment, the ejectors include an air nozzle under control of the central controller 12. The air nozzle provides a focused blast of compressed air to propel the moving fastener onto the designated chute. In other embodiments, the ejectors can include a flipper mechanism. The flipper mechanism can physically knock the fastener onto the designated chute under control of the central controller 12. In still other embodiments, a single ejector can be used to selectively direct the fastener to the designated chute. For example, the single ejector can include a rotatable diverter plate to selectively divert each fastener into the designated chute under control of the central controller 12. First and second part ejection sensors 57, 59 are provided immediately upstream of the first and second ejectors 56, 58 to ensure that each ejection is properly timed. Like the part tracking sensors 42, 44, the part ejection sensors 57, 59 include LED emitter and detector pairs. Other part ejection sensors can be used in other embodiments where desired.

Figure 6:
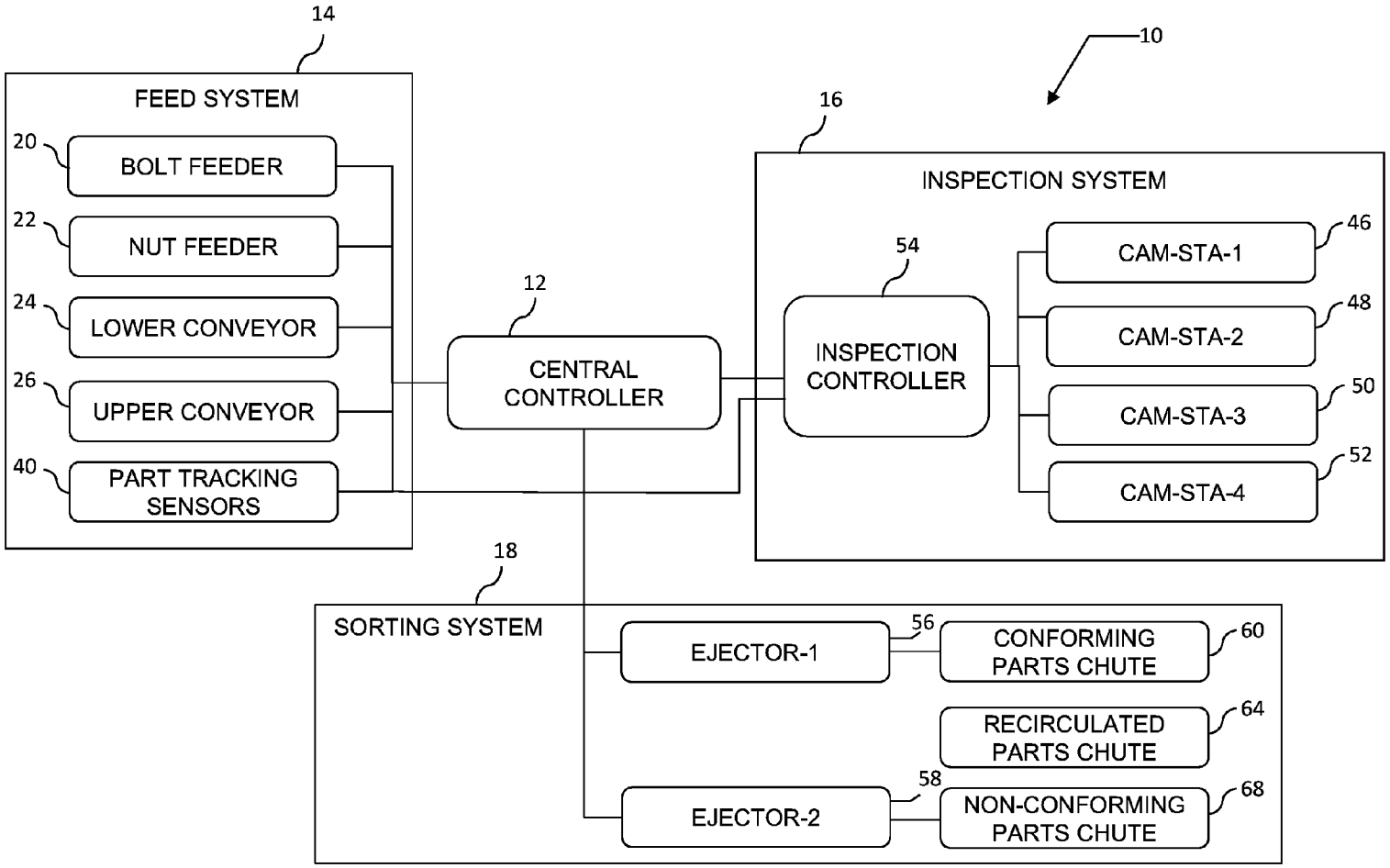
FIG. 6 is a schematic diagram of the constituent systems of the inspection and sorting machine of FIG. 1 in accordance with a first alternative embodiment.
Figure 7:
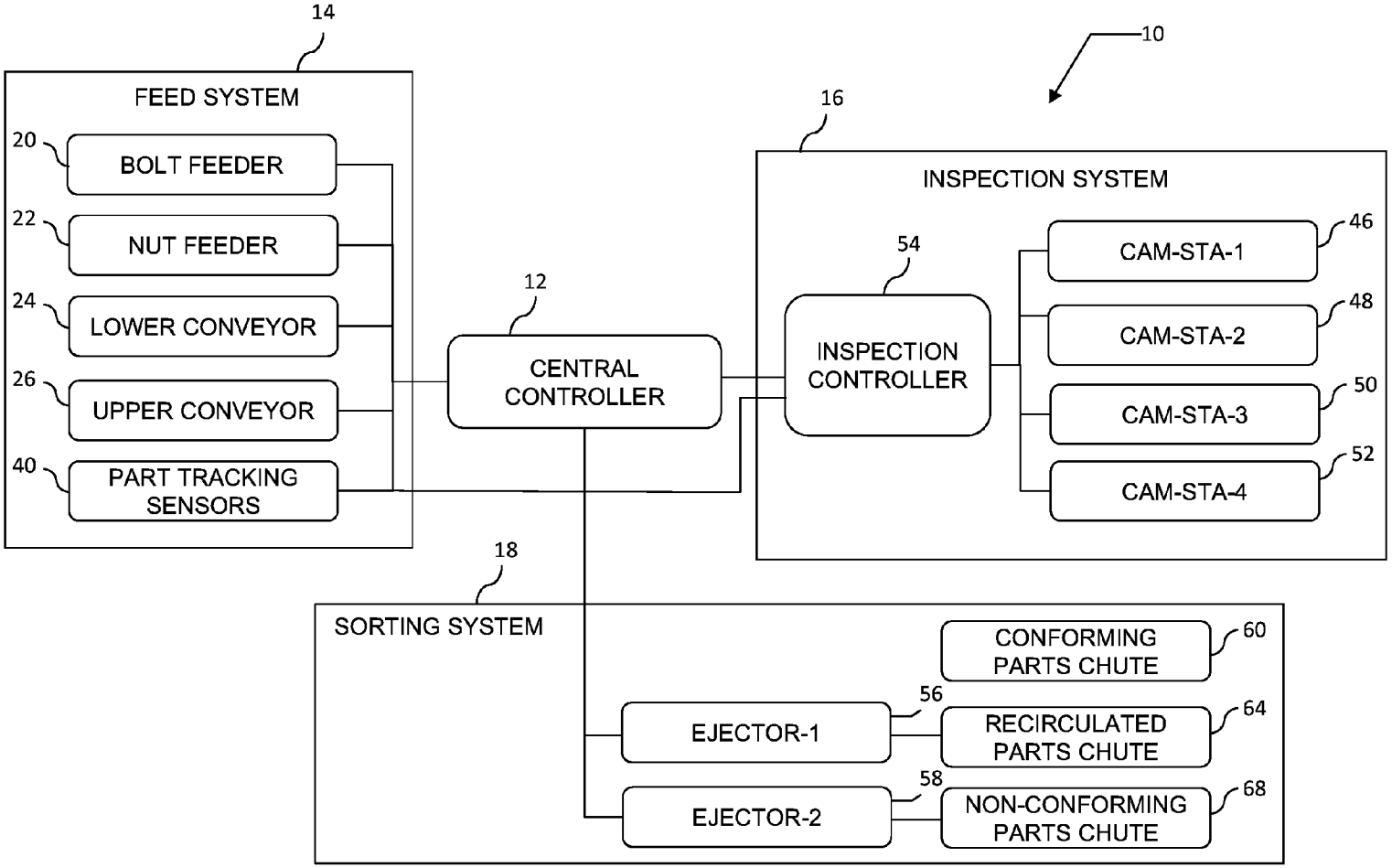
FIG. 7 is a schematic diagram of the constituent systems of the inspection and sorting machine of FIG. 1 in accordance with a second alternative embodiment.
Figure 8:
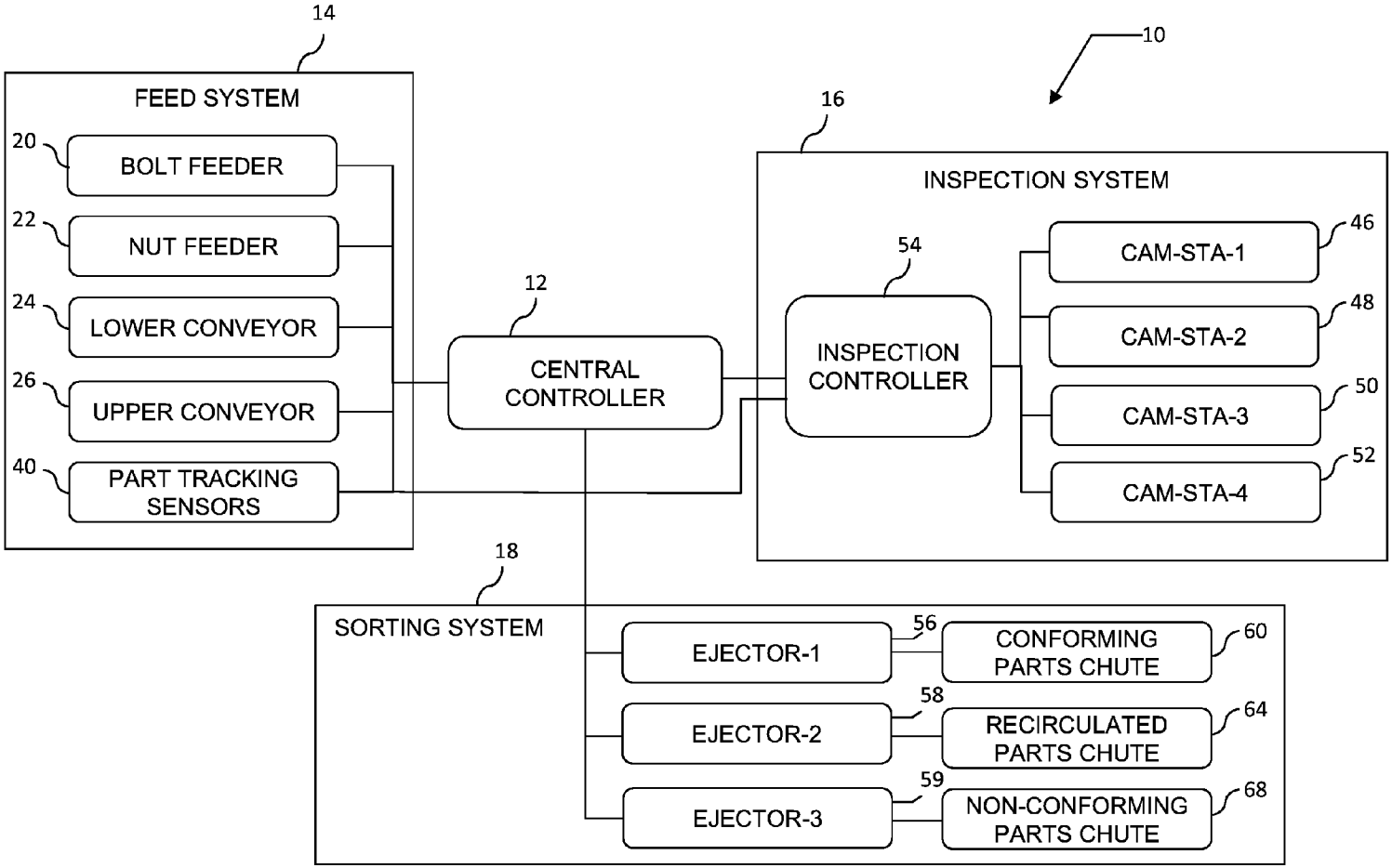
FIG. 8 is a schematic diagram of the constituent systems of the inspection and sorting machine of FIG. 1 in accordance with a third alternative embodiment.
Figure 9:
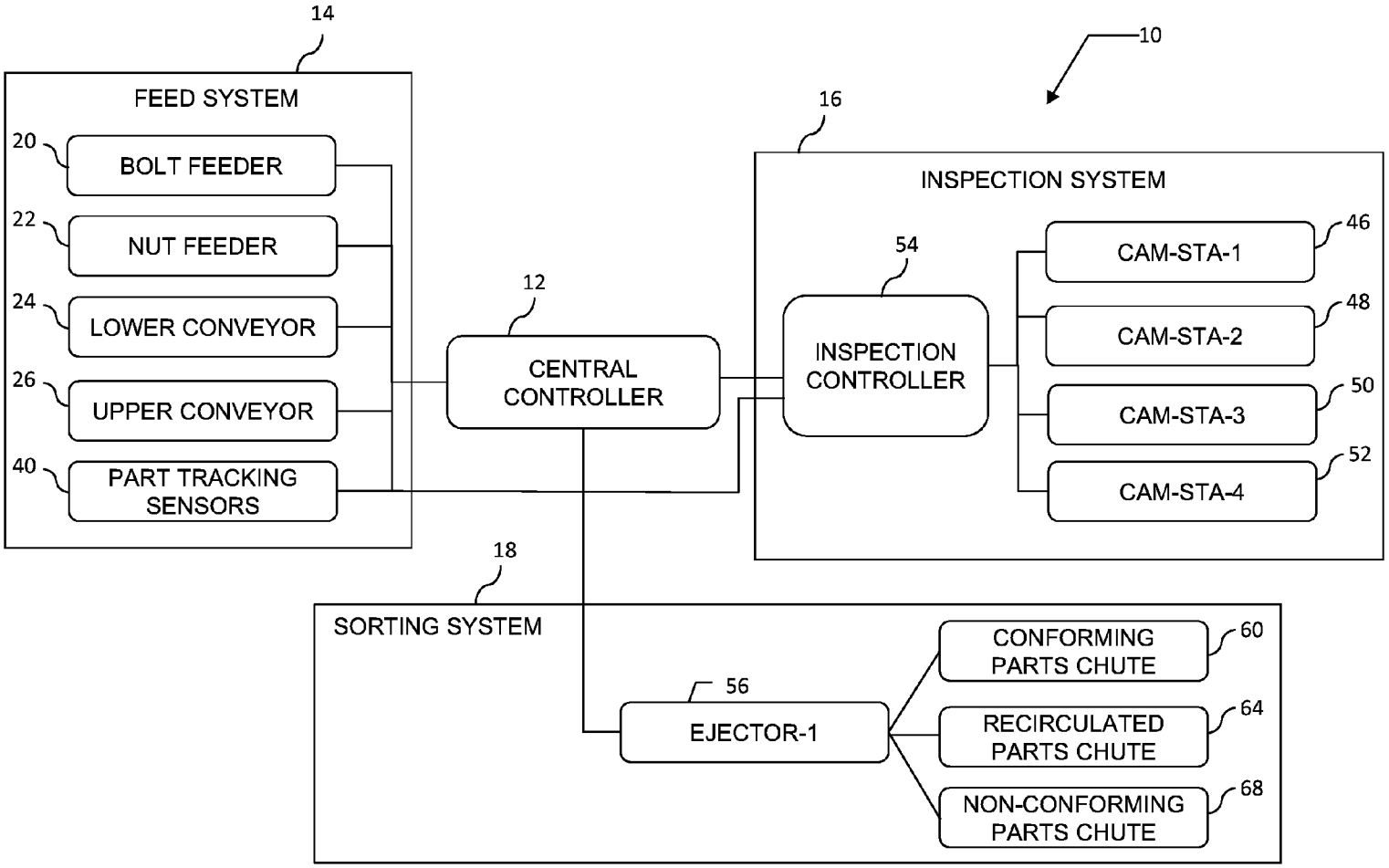
FIG. 9 is a schematic diagram of the constituent systems of the inspection and sorting machine of FIG. 1 in accordance with a fourth alternative embodiment.

As noted above, the first and second ejectors 56, 58 remove the conforming fasteners and the undetermined fasteners from the upper conveyor 26. Incidentally, the total failure of the central controller 12 can result in all fasteners on the conveyors 24, 26 being received by the non-conforming parts chute 68, which does not include an ejector. In other embodiments, the first and second ejectors 56, 58 remove the conforming fasteners and the non-conforming fasteners from the upper conveyor 26, respectively (generally shown in FIG. 6). In other embodiments, the first and second ejectors 56, 58 remove the conforming fasteners and the non-conforming fasteners from the upper conveyor 26, respectively (generally shown in FIG. 7). In still other embodiments, first, second and third ejectors 56, 58, 59 remove the conforming fasteners, the undetermined fasteners, and the non-conforming fasteners from the upper conveyor 26 (generally shown in FIG. 8). In even other embodiments, a single ejector 56 selectively directs the fasteners to the designated chute (generally shown in FIG. 9).

Figure 2:
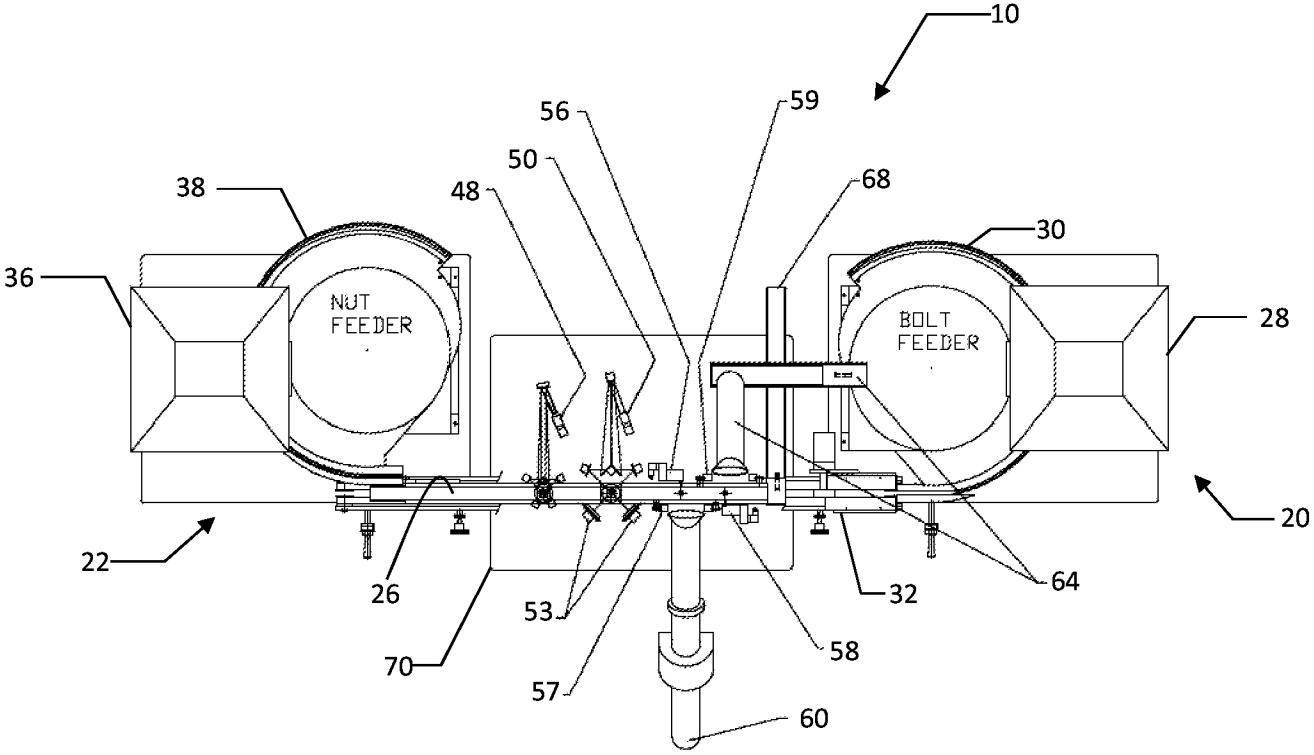
FIG. 2 is a top view of the inspection and sorting machine of FIG. 1 with a cabinet enclosure removed and with the addition of a bolt feeder and a nut feeder.

Referring again to FIGS. 1-4, the first ejector 56 causes the conforming fasteners to enter a conforming parts chute 60. The conforming parts chute 60 is oriented perpendicular to the upper conveyor 26 as shown in FIG. 2, opposite of the first ejector 56. The conforming parts chute 60 is also angled downwardly and terminates in an opening 61. Fasteners fall through the opening 61 and into a container or onto a further conveyor. Similarly, the second ejector 58 causes the undetermined fasteners to enter a recirculation chute 64. The recirculation chute 64 is oriented perpendicular to the upper conveyor 26 as shown in FIG. 2, opposite of the second ejector 58. The recirculation chute 64 is angled downwardly and terminates in a U-shaped opening. As shown in FIG. 2, the recirculation chute 64 includes a first segment perpendicular to the upper conveyor 26 and a second segment parallel to the upper conveyor 26. The second segment is laterally offset with respect to the upper conveyor 26, and terminates directly above the bolt feeder 20, such that undetermined fasteners fall directly into the bolt feeder 20 for re-inspection. Lastly, the non-conforming fasteners are allowed to continue along the upper conveyor 26 before falling onto a non-conforming parts chute 68. In other embodiments, a stationary diverter plate can deflect the non-conforming fasteners onto the non-conforming parts chute 68. In both instances, the non-conforming fasteners continue onto the non-conforming parts chute 68 without activation by the central controller 12. In other embodiments, however, the central controller 12 can activate a third ejector to actively eject the non-conforming fasteners from the upper conveyor 26.

The inspection and sorting machine 10 additionally includes a freestanding base 70 for supporting the conveyor belts 24, 26 and a housing 72 for substantially enclosing the conveyor belts 24, 26. The housing 70 includes a touch screen 74 or other user interface for controlling one or more operating parameters of the inspection and sorting machine 10. One operating parameter includes the number of conforming fasteners to be received within each parts box. Once an existing parts box is full, the sorting system 18 automatically replaces the existing parts box with an empty parts box. During this transition, the sorting system 18 suspends the discharge of conforming fasteners through the conforming parts chute 60. The conforming fasteners are instead discharged through the recirculation chute 64 and into the bolt feeder 20. Once the transition is complete, the sorting system 18 resumes the discharge of conforming fasteners through the conforming parts chute 60. The above transition is not representative of a system fault, however, and the conforming fasteners are not ejected into the non-conforming parts chute 68 in the example set forth above.

Figure 5:
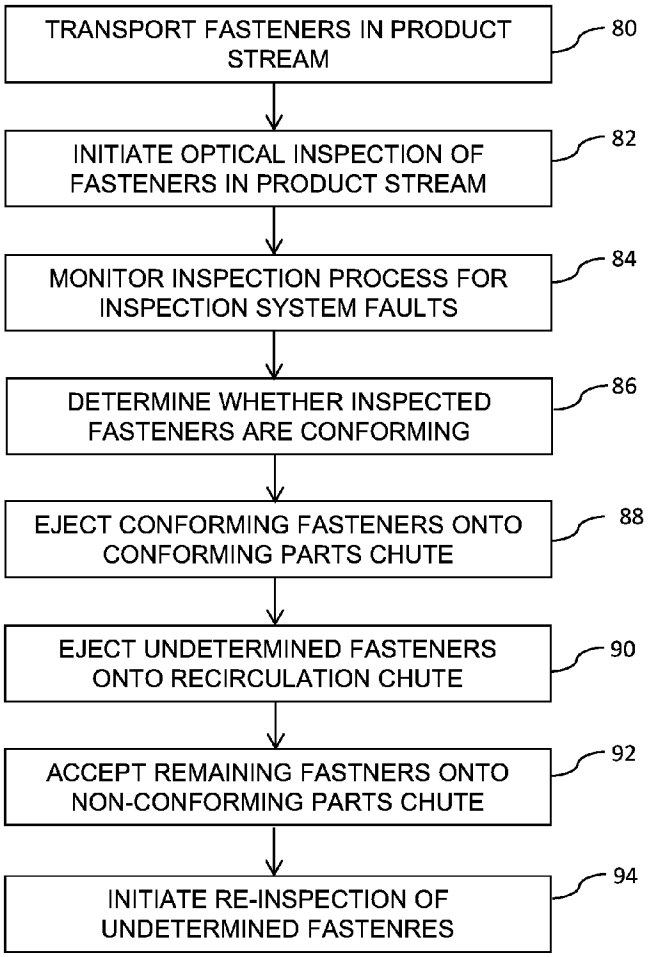
FIG. 5 is a flow chart for a method of operation in accordance with the embodiment of FIG. 1.

A related method of operation is presented in greater detail in connection with the flow chart of FIG. 5. In particular, the flow chart of FIG. 5 includes a method of sorting a plurality of fasteners, the method including: (a) transporting a plurality of fasteners in a product stream; (b) initiating an optical inspection of each of the plurality of fasteners in the product stream; (c) monitoring the inspection process for each fastener for system faults; (d) determining whether each fastener meets a fastener criteria; (e) ejecting, into a conforming fasteners chute, fasteners meeting the fastener criteria and having an inspection substantially free of system faults; (f) ejecting, into a recirculation chute, the undetermined fasteners whose inspection (or attempted inspection) was accompanied by a system fault; (g) accepting, into a non-conforming fastener chute, all remaining fasteners in the product stream; and (h) initiating a re-inspection of the undetermined fasteners.

Transporting a plurality of fasteners in a product stream is depicted as step 80 in FIG. 5. This step generally includes transporting, positioning, and tracking the fasteners for optical inspection and sorting. Transporting the fasteners can include moving the fasteners along a lower conveyor 24 and inverting the fasteners onto an upper conveyor 26 for optical inspection of the head and shank, respectively. A slotted ramp 32 assists in positioning the upright fasteners onto the lower conveyor 24 and a magnetic wheel 34 assists in positioning the inverted fasteners onto the upper conveyor 26. First and second part tracking sensors 42, 44 assist in tracking the fasteners as they progress through an optical inspection station.

Initiating an optical inspection of each fastener is depicted as step 82 in FIG. 5. This step generally includes obtaining one or more images of each fastener for output to an inspection controller. The one or more images can include a top-down image of an upright bolt, a top-down image of an inverted bolt, and side images of an inverted bolt. The one or more images can alternatively include a top-down image of a nut or washer and a side image of a nut or washer. The one or more images are then output to an inspection controller for evaluation.

Monitoring the inspection process for inspection system faults is depicted as step 84 in FIG. 5. This step generally includes determining whether the inspection and sorting processes meet one or more inspection criteria. The inspection criteria can include fastener spacing, fastener orientation, fastener speed, or fastener location, each within desired tolerances. For fasteners that meet these inspection criteria, the optical inspection is determined to be satisfactory. For fasteners that do not meet any one of these inspection criteria, the optical inspection is determined to be unsatisfactory. This can occur in instances where the fastener is tipped over, out of position, or too close to an adjacent fastener. For unsatisfactory inspections, the inspection controller 54 can transmit a fault signal to the central controller 12. Consequently, the absence of a fault signal will generally indicate that the optical inspection met the relevant inspection criteria. The inverse is also possible, in which instance the presence of a satisfactory inspection signal indicates that the optical inspection met the relevant inspection criteria.

For fasteners having a satisfactory optical inspection, the method includes determining whether such fasteners are conforming. This step is depicted as step 86 in FIG. 5, and generally includes comparing a measured fastener parameter against a reference fastener parameter. For fasteners that are within expected tolerances of the reference fastener parameter, the optical fastener is determined to be conforming. For conforming fasteners, the inspection controller 54 can transmit a pass signal to the central controller 12. Consequently, the absence of a pass signal will generally indicate that the fastener (if properly inspected) was non-conforming.

Ejecting conforming fasteners is depicted as step 88 in FIG. 5. This step generally includes selectively activating a first ejector 56 to eject only those fasteners having met the inspection criteria (e.g., the absence of fault signal) and having met the fastener criteria (e.g., the presence of a pass signal). The ejector 56 can include any device adapted to remove a fastener from the upper conveyor 26 in response to a control signal from the central controller 12. In the illustrated embodiment, the ejector 56 includes an air nozzle that provides a focused blast of compressed air. In other embodiments, the ejector 56 includes a flipper plate to knock the fastener from the upper conveyor 26. Other ejectors can be used in other embodiments as desired.

Ejecting undetermined fasteners is depicted as step 90 in FIG. 5. This step generally includes selectively activating a second ejector 58 to eject only those fasteners having failed the inspection criteria (e.g., the presence of fault signal), without regard to whether the inspection controller also generated a pass signal. As with the first ejector 56, the second ejector 58 can include any device adapted to remove a fastener from the upper conveyor 26 in response to a control signal from the central controller 12. In the illustrated embodiment, the second ejector 58 includes an air nozzle that provides a focused blast of compressed air. In other embodiments, the second ejector 58 includes a flipper plate to knock the fastener from the upper conveyor 26. Other ejectors can be used in other embodiments as desired. The ejected fasteners are optionally directed into a feed station 20 for automatic re-circulation and re-imaging.

Accepting the remaining fasteners is depicted as step 92 in FIG. 5. This step generally includes allowing the remaining fasteners to freely fall from the upper conveyor 26 after passing the first and second ejectors 56, 58. These remaining fasteners represent those fasteners that met the inspection criteria (e.g., the absence of fault signal) but failed the fastener criteria (e.g., the absence of a pass signal). In other embodiments, these remaining fasteners, termed "non-conforming fasteners" herein, can be actively ejected from the upper conveyor 26. The non-conforming fasteners are then discarded by the operator.

Initiating a re-inspection of the undetermined fasteners is depicted as step 94 in FIG. 5. This step generally includes the re-introduction of the undetermined fasteners through the inspection and sorting machine 10. Ideally, the system faults that manifested in the initial inspection are not recurring. For some system faults (e.g., low nozzle air pressure), remedial measures can prevent their re-occurrence. For other system faults, however, remedial measures are not necessary, and the system faults (spacing, speed, orientation, etc.) are unlikely to repeat. Consequently, the uninspected fasteners from the initial inspection are likely to be sorted as conforming fasteners or non-conforming fasteners in the second inspection, optionally without manual intervention. The re-introduction of undetermined fasteners through the inspection and sorting machine 10 is automatic in the embodiment illustrated in FIGS. 1-4, but can be manual in other embodiments. For example, the recirculation chute 64 can discharge into a container, which can then be manually emptied into the bolt feeder 20 or nut feeder 22 by the operator.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A method for inspecting and sorting a plurality of fasteners, the method comprising:

transporting a plurality of fasteners in a product stream, each of the plurality of fasteners being directed through an inspection system;

initiating an optical inspection of the plurality of fasteners in the product stream, each of the plurality of fasteners including a measurable fastener parameter;

determining, for each of the plurality of fasteners, whether the optical inspection is impeded by an improper fastener orientation within the inspection system as a system fault;

determining, for each of the plurality of fasteners having been inspected without a system fault, whether the measurable fastener parameter is within predetermined tolerances;

ejecting, into a chute for conforming fasteners, fasteners having a measurable fastener parameter within predetermined tolerances;

ejecting, into a chute for re-inspection, fasteners for which the optical inspection included a system fault; and accepting, into a chute for non-conforming fasteners, fasteners that were transported past the chute for conforming fasteners and the chute for re-inspection.

2. The method according to claim 1 wherein the system fault is further based on a defect in at least one of fastener spacing, fastener speed, and fastener visibility.

3. The method according to claim 1 wherein the system fault is further based on controller overrun or controller inoperability.

4. The method according to claim 1 further including generating a fault signal for fasteners in which the optical inspection included a system fault.

5. The method according to claim 1 further including automatically re-inspecting the fasteners having been ejected into the chute for re-inspection.

6. The method according to claim 1 wherein the measurable fastener parameter includes dimensional parameters and non-dimensional parameters.

7. A method of sorting fasteners comprising:

transporting a plurality of fasteners in a product stream, each of the plurality of fasteners being directed through an inspection system, the inspection system being adapted to sequentially image each of the plurality of fasteners in the product stream, the inspection system being further adapted to output a first signal corresponding to a fastener dimension and a second signal corresponding to an inspection parameter;

determining, for each of the plurality of fasteners, (a) conformance of the fastener dimension with a predetermined dimensional criteria, and (b) conformance of the inspection parameter with a predetermined inspection criteria for fasteners having a desired fastener orientation within the inspection system;

receiving, into a conforming parts chute, fasteners having a dimension in conformance with the predetermined dimensional criteria and having an inspection parameter in conformance with the predetermined inspection criteria;

receiving, into a recirculated parts chute, fasteners lacking the desired fastener orientation within the inspection system such that the inspection parameter was not in conformance with the predetermined inspection criteria; and receiving, into a reject chute for disposal, fasteners from the product stream that were transported past the conforming parts chute and the recirculated parts chute.

8. The method according to claim 7 further including automatically repeating the determining step for the fasteners having been received into the recirculated parts chute.

9. The method according to claim 7 wherein the second signal is further based on at least one of fastener spacing, fastener speed, and fastener visibility.

10. An inspection and sorting machine comprising:

a feed system adapted to transport a plurality of fasteners in a product stream, each of the plurality of fasteners including a measurable fastener parameter;

an inspection system adapted to initiate an optical inspection of each of the plurality of fasteners, the inspection system including a camera and an inspection controller, the inspection controller providing an output;

a central controller electrically coupled to the inspection controller and adapted to determine, for each of the plurality of fasteners, whether the optical inspection was impeded by an improper fastener orientation within the inspection system as a system fault and, if not, whether the measurable fastener parameter is within predetermined tolerances of a reference fastener parameter; and a sorting system including:

a first ejector for ejecting, into a first chute, fasteners having a measurable fastener parameter within predetermined tolerances of the reference fastener parameter, a second ejector for ejecting, into a second chute, fasteners for which the central controller detected a system fault, the second chute directing fasteners to the feed system for re-inspection by the inspection system, and a third chute for accepting fasteners for disposal, the fasteners for disposal having been transported past the first and second ejectors without being ejected into the first or second chutes.

11. The machine of claim 10 wherein the inspection controller output includes a fault signal for fasteners for which the optical inspection included the system fault.

12. The machine of claim 11 wherein the fault signal further indicates at least one of incorrect fastener spacing, obscuration of the fastener, excessive fastener speed, and combinations thereof.

13. The machine of claim 10 wherein the inspection controller output includes a pass signal for fasteners for which the measurable fastener parameter is within predetermined tolerances.

14. The machine of claim 10 wherein the fasteners ejected into the third chute are at least one of nonconforming, malformed and defective.

15. The machine of claim 10 wherein the first and second ejectors each include a pneumatic air nozzle responsive to the central controller.

16. An inspection and sorting machine comprising:

a feed system for delivering a plurality of fasteners in a product stream;

an inspection system including a camera to view the plurality of fasteners in the product stream, the inspection system adapted to output a first signal corresponding to a fastener condition and a second signal corresponding to an inspection system fault;

a central controller adapted to determine for each of the plurality of fasteners, based on the inspection system output, whether the fastener is classified as conforming or whether the fastener is classified as undetermined, the undetermined fasteners being associated with an inspection system fault based on an improper fastener orientation within the inspection system;

a first ejector to divert the conforming fasteners into a first chute;

a second ejector to divert the undetermined fasteners into a second chute for recirculation through the inspection system; and a third chute to accept the remaining fasteners from the product stream for disposal, the remaining fasteners having been transported past the first and second ejectors without being ejected into the first and second chutes.

17. The machine of claim 16 wherein the inspection system fault further indicates at least one of incorrect fastener spacing, obscuration of the fastener, contamination of the camera, excessive fastener speed, central controller overrun, and combinations thereof.

18. The machine of claim 16 wherein the fastener condition includes at least one of a dimensional parameter and a non-dimensional parameter.

19. The machine of claim 16 wherein the feed system includes a lower conveyor and an upper conveyor having a magnetic wheel for inverting the plurality of fasteners.

20. The machine of claim 16 wherein the first and second ejectors each include a pneumatic air nozzle responsive to the central controller.

* * * * *